US005346331A

United States Patent [19]

Glang et al.

[11] Patent Number: 5,346,331

[45] Date of Patent: Sep. 13, 1994

[54] SHIELD TAIL SEALING

[75] Inventors: Siegfried Glang, Hamburg; Lothar Anheuser, Bad Nauheim, both of Fed. Rep. of Germany

[73] Assignee: Phoenix Aktiengesellschaft, Hamburg, Fed. Rep. of Germany

[21] Appl. No.: 30,373

[22] PCT Filed: Oct. 10, 1992

[86] PCT No.: PCT/DE92/00860

§ 371 Date: Mar. 19, 1993

§ 102(e) Date: Mar. 19, 1993

[87] PCT Pub. No.: WO93/08370

PCT Pub. Date: Apr. 29, 1993

[30] Foreign Application Priority Data

Oct. 18, 1991 [DE] Fed. Rep. of Germany ..... 4134433

[51] Int. Cl.[5] ..... E21D 9/06

[52] U.S. Cl. ..... 405/147; 405/146; 405/141

[58] Field of Search ..... 405/147, 141, 146, 138, 405/132; 299/31, 33

[56] References Cited

U.S. PATENT DOCUMENTS 3,910,058 10/1975 Fouillade ..... 405/147 X
3,979,920 9/1976 Burgess et al. ..... 405/147

FOREIGN PATENT DOCUMENTS 2646570 4/1978 Fed. Rep. of Germany .
3206927 9/1983 Fed. Rep. of Germany .
4031072 4/1991 Fed. Rep. of Germany .

OTHER PUBLICATIONS

Patent Abstracts of Japan, vol. 14, No. 335, Jul. 19, 1990.

*Primary Examiner*—Dennis L. Taylor
*Attorney, Agent, or Firm*—Collard & Roe

[57] ABSTRACT

The invention relates to a shield tail sealing (7) for driving shields consisting of a basic body (2) made of elastomeric material and having a substantially rectangular cross section in the longitudinal direction and being inclined against the driving direction, whereby a sealing nose (12) is formed by molding at its sliding end on the inner side (inner side 11), which nose, in the operating condition, elastically presses against the outer side (4) of the tunnel lining, as well as a holding means (8) extending substantially contrally in the basic body (2), said means being fastened on a mounting support (10) arranged on the shield tail (9). The essence of said invention is that in the upper zone adjacent to the shield tail (9), the basic body (2) has on the outer side (outer side 13) at least one sealing lip ( 14 ) of which the nose (18 ) , in the installed condition, projects beyond the outer surface (19) of the shield tail (9) or jacket of the shield.

16 Claims, 6 Drawing Sheets

SHIELD TAIL SEALING

The invention relates to a shield tail sealing for driving shields, said sealing consisting of a basic body made of elastomeric (rubber or rubber-like) material having a substantially rectangular cross section in the longitudinal direction and being inclined against the driving direction, whereby a sealing nose is formed by molding on its sliding end on the inner side which nose, in the operating condition, presses elastically against the outer side of the tunnel lining; as well as of a holding means extending substantially centrally in the basic body and being fastened on a mounting support arranged on the tail (end part of the jacket of the shield) of the shield.

In the shield driving process, an annular gap forms behind the shield tail, which gap is outwardly limited by the surrounding rock or soil, and inwardly by the lining (encasement; tubing segments) of the tunnel. The sealing between the shield and the tunnel construction is accomplished by means of a shield tail sealing. In this connection, the annular gap has to be completely filled with injection mortar, whereby it is customary to carry out such injection through openings in the tubing segments or through pipelines through the shield.

A shield tail sealing according to this type is known from DE-C-32 06 927. This sealing has been tested in practical application; however, the problem of injecting under pressure with overcut (break-outs) in the stable soil (e.g. always in rocky sections) has not been resolved satisfactorily heretofore.

It is, therefore, the object of the present invention to make available a shield tail sealing which even with such overcut prevents the injection mortar from getting into the zone of the shield machine. This problem is resolved by the present invention.

The invention is explained hereinafter in greater detail on the basis of exemplified embodiments and by reference to the schematic drawings, in which.

Figure 7:
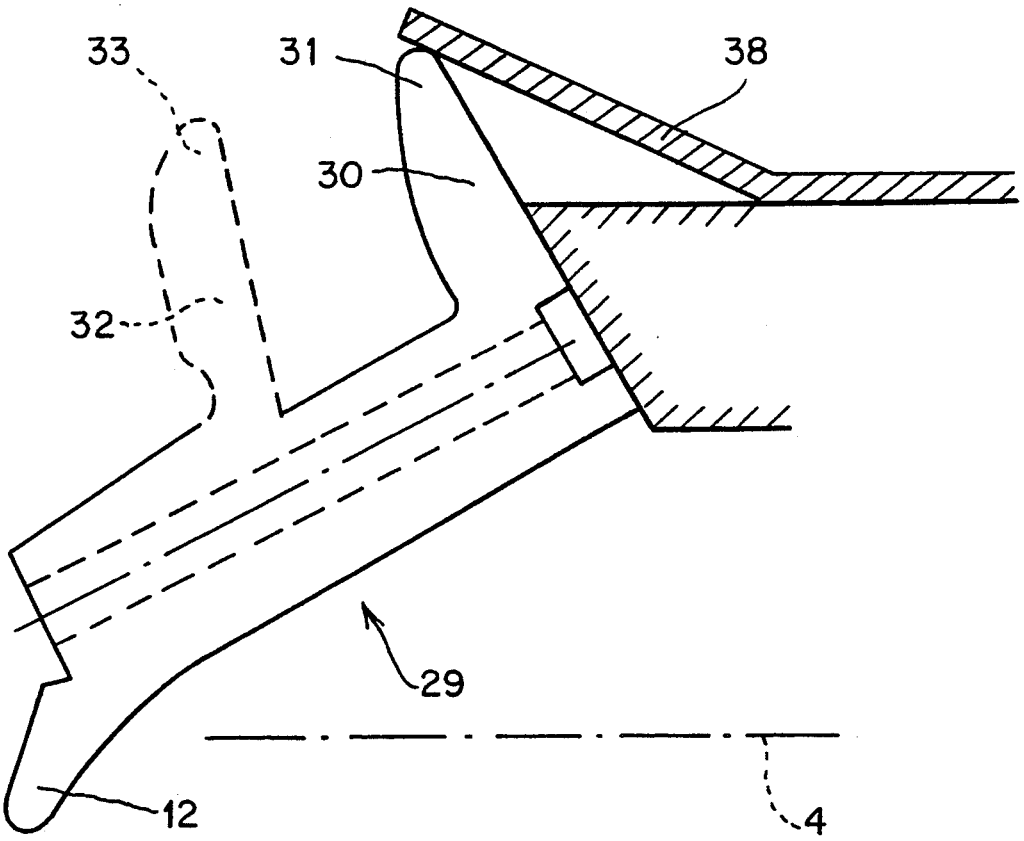

FIG. 7 a shield tail sealing with a drag metal sheet.

Figure 1B:
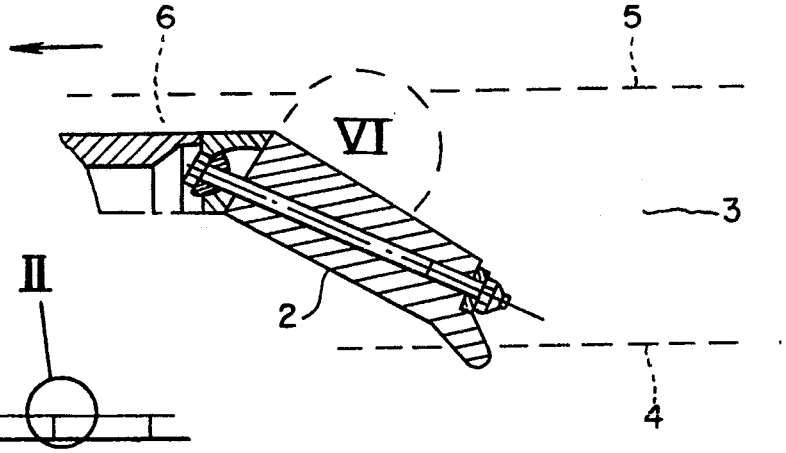
FIGS. 1A and 1B show the shield drive by the tubing method of construction (FIG. 1A) as well as the basic structure of the shield tail sealing (FIG. 1B)
Figure 1A:
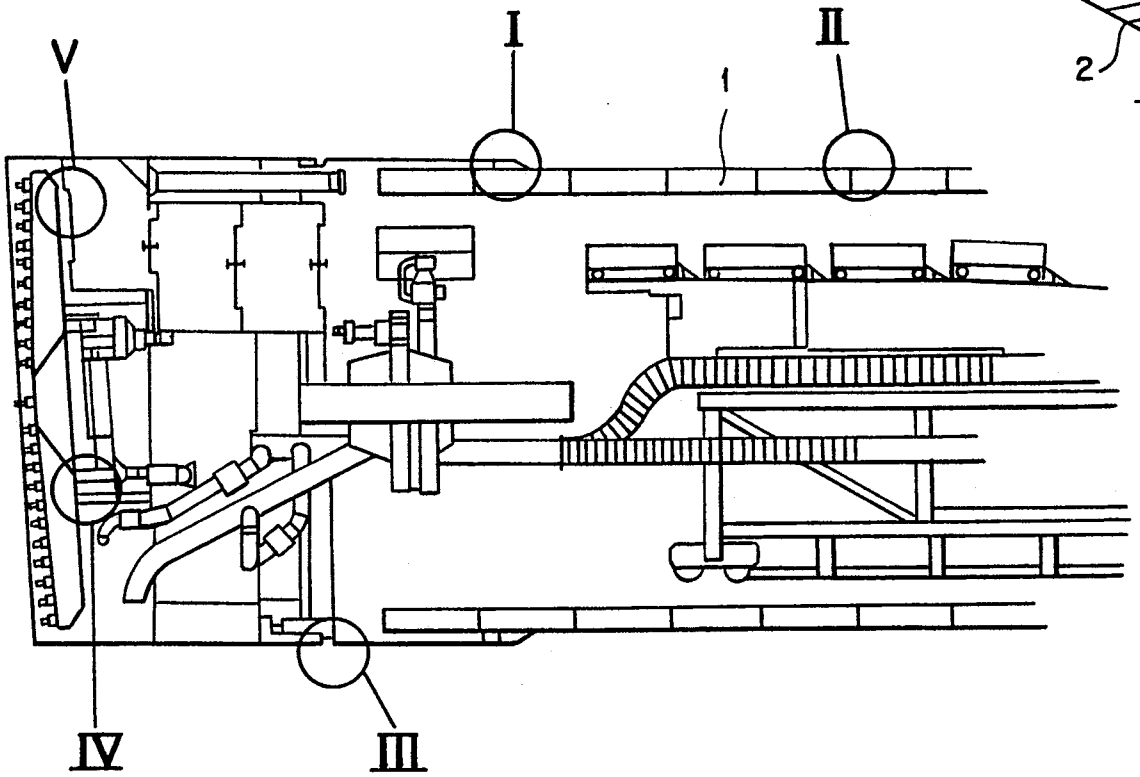

FIG. 1A shows the shield drive by the tubing method of construction (tubing segments 1), whereby sealing profiles made of elastomeric material are used in the zones I to V, said profiles having different application-specific basic structures. In detail:

I=shield tail sealing (FIG. 1B);
II=tubing seal;
III=jointed shield sealing;
IV=sealing for the cutting wheel displacement;
V=pressure door sealing.

Now, FIG. 1B shows the shield tail sealing according to the type of the invention, whereby the basic body (2), which is inclined against the driving direction (direction indicated by the arrow), has in the upper zone (VI) adjacent to the shield tail on the outer side at least one sealing lip—hereinafter referred to as the outer sealing lip—according to the invention which, when the annular gap (3) between the outer side (4) of the tubing segments and the geological tunnel environment (5) is filled, prevents the injection mortar from getting into the zone of the shield machine even with an overcut (6).

Figure 2:
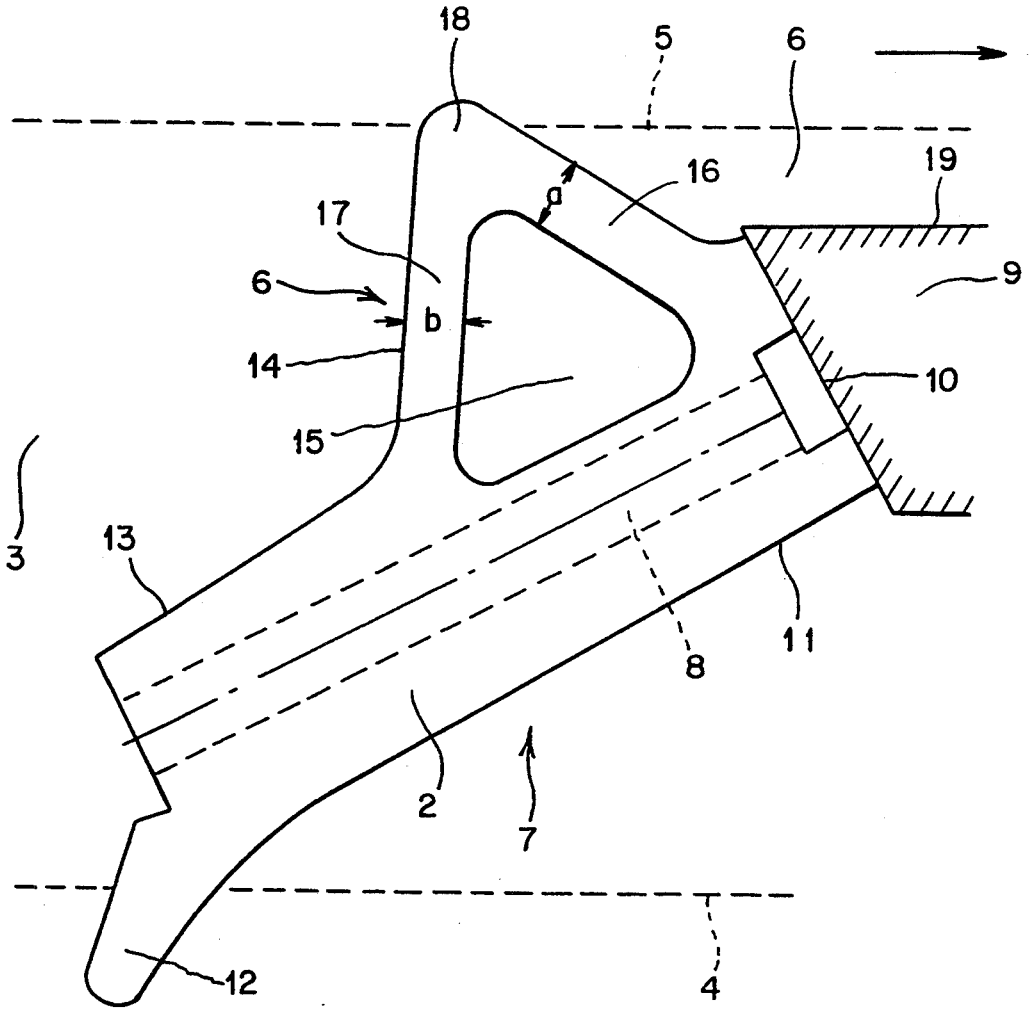
FIGS. 2 to 4 show shield tail sealings with one single outer sealing lip with a substantially triangular cross sectional shape (variation A)

According to FIG. 2, the basic body (2) of the shield tail sealing (7) has a substantially rectangular cross section in the longitudinal direction. A holding-means (8) extending substantially centrally in said basic body is fastened on a mounting support (10) arranged on the shield tail (9). A sealing nose (12) is formed by molding on the sliding end of the inner side (11) of the basic body, which nose, in the operating condition, elastically presses against the outer side (4) of the tunnel lining. Now, in the upper zone adjacent to the shield tail (9), the outer side (13) of the basic body has an outer sealing lip (14) which, viewed cross sectionally, has a substantially triangular shape. This outer sealing lip is provided with one single duct (15) also having a substantially triangular cross sectional form, namely with formation of two legs (16, 17) converging in an acute angle, said legs having a minimum wall thickness of 15 mm. In this connection, the wall thickness a of the leg (16) facing the shield tail (9) is usefully greater than the wall thickness b of the leg (17) averted from the shield tail. The nose (18) of the outer sealing lip (14) projects in the installed condition (shown here) beyond the outer surface (19) of the shield tail or jacket of the shield. In this way, when there is an overcut (6), which is the gap between the outer surface (19) and the geological tunnel environment (5), the injection mortar—which is pressed under pressure into the annular gap (3)—is prevented from getting into the shield machine. Even with an injection pressure of up to 5 bar and maximum overcut of 20 mm the nose (18) of the outer sealing lip (14) will not tilt over in the forward direction, i.e., in the driving direction (arrow direction).

Figure 3:
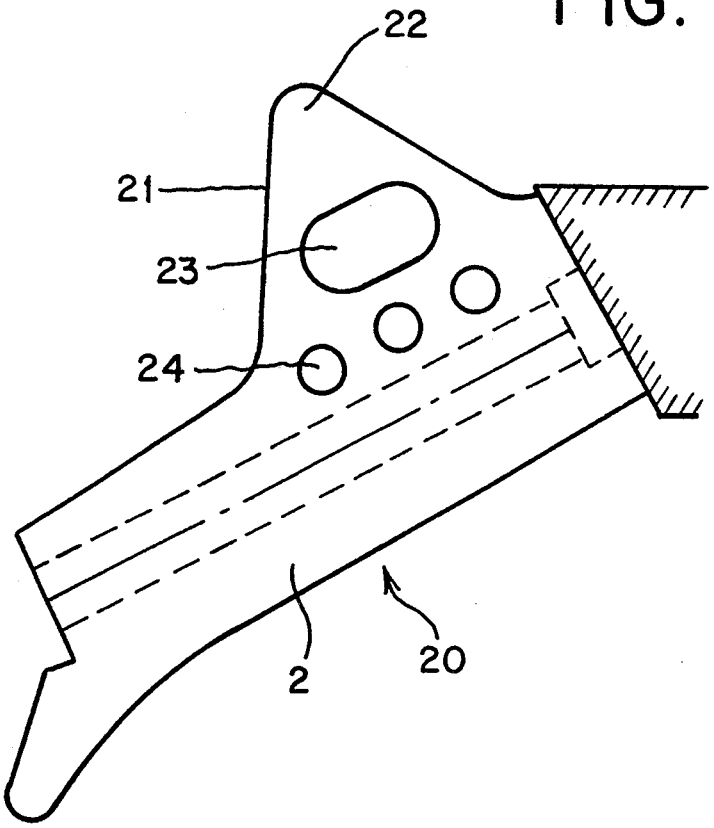

Now, FIG. 3 shows a shield tail sealing (20) also having a triangularly shaped (viewed cross sectionally) outer sealing lip (21) which, however, has a two-row arrangement of ducts. In this connection, the row facing the nose (22) consists of one single duct (23) which, viewed cross sectionally, has an oval shape (largest diameter in the longitudinal direction of the basic body), whereas the row facing the basic body (2) consists of three ducts (24) having a substantially circular cross sectional structure.

Figure 4:
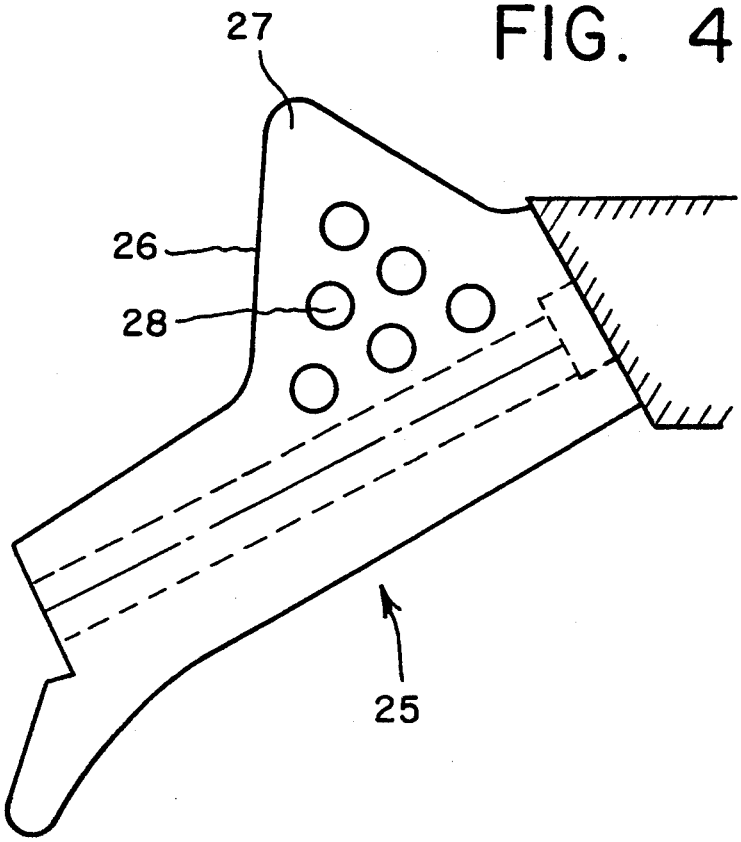

According to FIG. 4, the shield tail sealing (25) again has a triangularly shaped (viewed cross sectionally) outer sealing lip (26) with the nose (27), whereby, however, the ducts are arranged in three rows in the present case. All ducts (28) have a substantially circular cross sectional structure and form a lattice structure.

Figure 5:
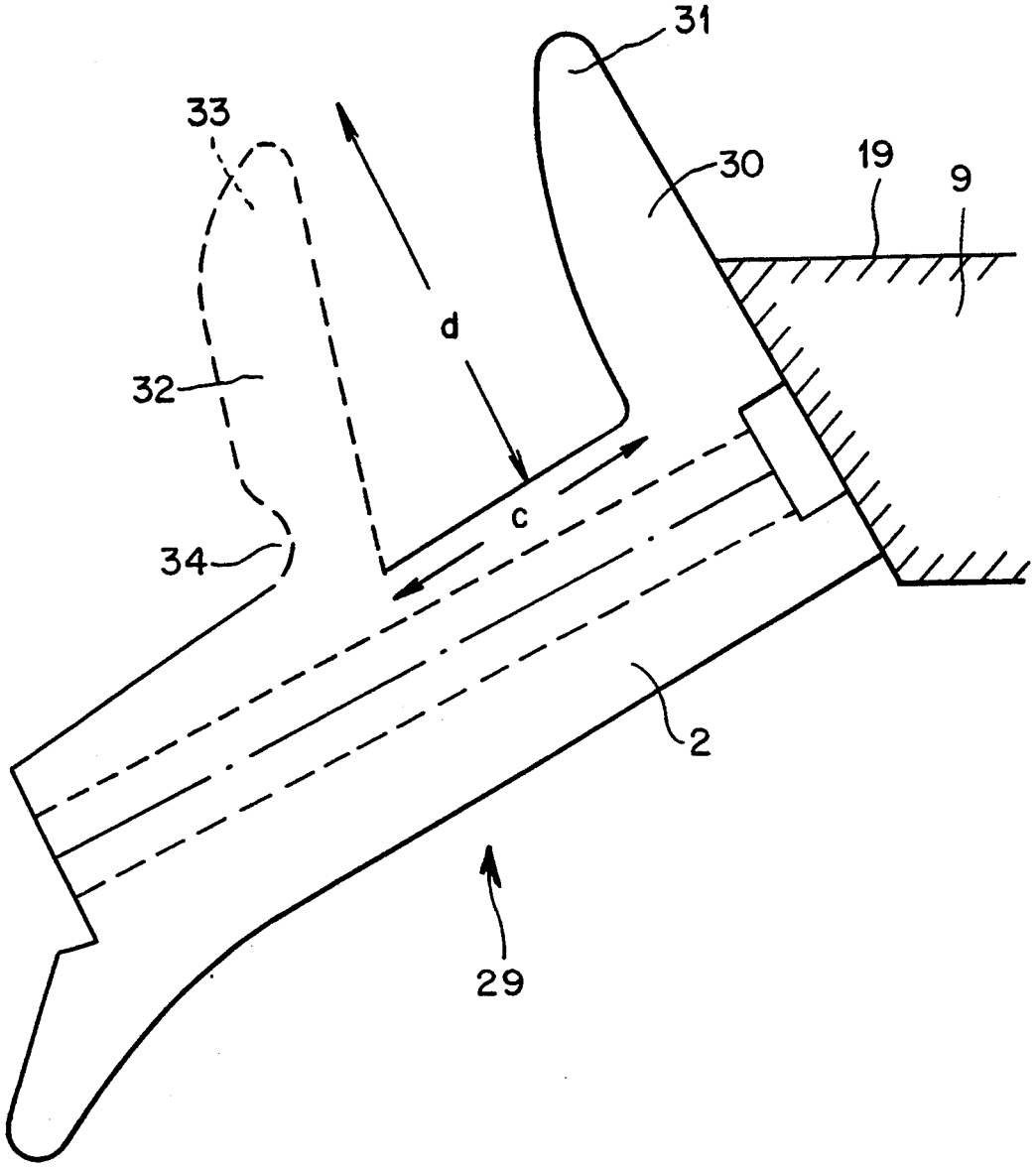
FIG. 5 shows a shield tail sealing with at least one outer sealing lip with a substantially finger-shaped cross section form (variation B)

Now, FIG. 5 shows a shield tail sealing (29) with an outer sealing lip (30) which, viewed cross sectionally, has a substantially finger-shaped form, with its nose (31) in the installed condition (shown here) projecting beyond the outer surface (19) of the shield tail or shield jacket. The basic body (2) is usefully fitted with an additional finger-shaped outer sealing lip (32), whereby its nose (33) projects in the installed condition beyond the outer surface (19) as well. In this connection, in the zone of transition to the basic body, said additional outer sealing lip is provided with a notch (34) disposed on the side that is averted from the shield tail. The spacing c of the two sealing lips (30, 32), which substantially have the same length, should come to at least half of the lip length d.

Figure 6:
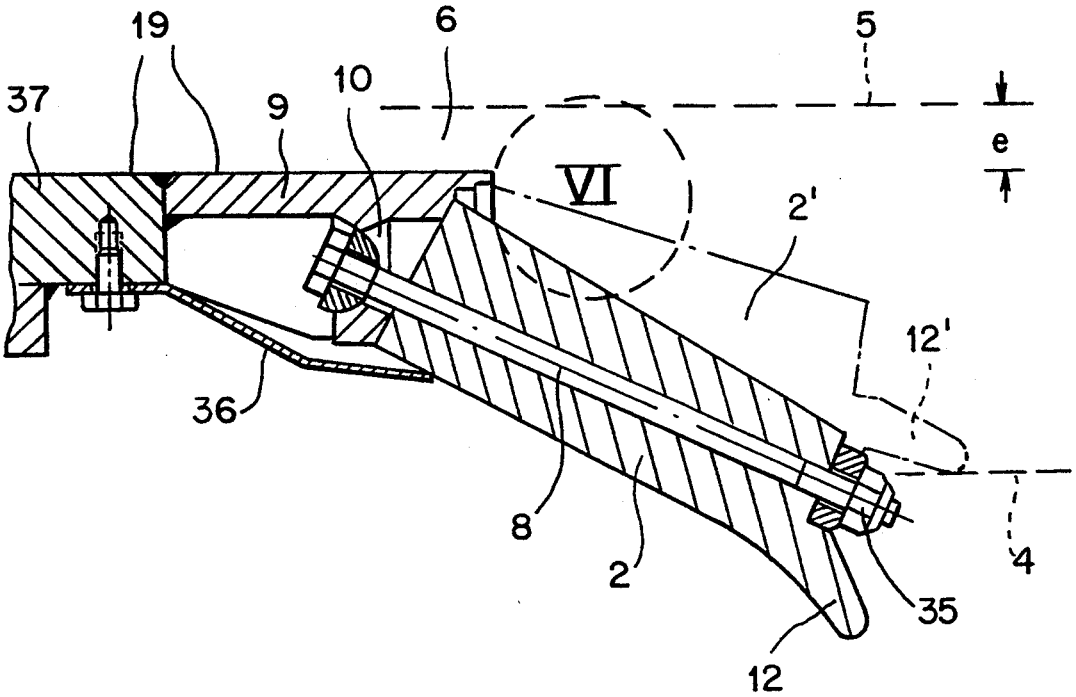
FIG. 6 shows a shield tail sealing with a spring metal sheet.

Now, FIG. 6 shows the basic body (2) with the sealing nose (12) molded onto said body and in the installed condition (hatched representation), and also the position of said basic body (2') and its sealing nose (12') in the operating condition, in which the nose (12') presses elastically against the outer side (4) of the tunnel lining. The holding means (8), which extends substantially centrally in the basic body, is fastened on the mounting support (10)—for which various embodiments are available—arranged on the shield tail (9). The shield tail sealing itself is replaceably anchored by means of the screw system (35). Now, on the side facing the tunnel lining (outer side 4), the shield tail sealing is usefully fitted with a spring metal sheet (36), which is fastened on the shield jacket (37)(e.g. by means of screws) and rests against the inner side within the upper zone of the basic body (2). In addition to the function of a dirt-repelling element the spring metal sheet (36) supports particularly the adaptation of the outer sealing lip (zone VI) according to the invention to the geological tunnel environment (5) with the overcut (6), whereby said tunnel environment does not, as a rule, extend uniformly, so that the overcut (6), too, changes constantly in its gap spacing e based on the outer surface (19) of the shield tail or shield jacket.

Now, FIG. 7 is intended to explain on the basis of the shield tail sealing (29) according to FIG. 5 another useful embodiment of the outer sealing-according to the invention. In this connection, the nose (31) of the outer sealing lip (30) is protected against abrasion by means of a drag metal sheet (38) that is mounted on the jacket of the shield. It has to be stressed in this connection that the break-outs in rocky sections have frequently very sharp edges, so that the abrasion acting on the unprotected outer sealing lip (30) will be much greater than the abrasion acting on the sealing nose (12), especially because the sealing nose (12) is elastically pressing against a substantially smooth outer side (4) of the tunnel lining.

A protection of the nose (33) of the sealing lip (32) against abrasion is not required.

We claim:

1. Shield tail sealing for driving shields for use with a tunnel lining which has an outer side and an upper zone, said sealing comprising a basic body made of elastomeric material and having an outer side and having a substantially rectangular cross section in a longitudinal direction and being inclined against a driving direction;

a sealing nose having an inner side, formed by molding at a sliding end on said inner side which, in an operating condition, elastically presses against said outer side of said tunnel lining;

a shield tail having a mounting support and an outer surface;

a holding means extending substantially centrally in the basic body and fastened on said mounting support of said shield tail; and in said upper zone adjacent to the shield tail, the basic body having on the outer side at least one outer sealing lip having a lip nose of which said lip nose in an installed condition projects beyond the outer surface of the shield tail.

2. Shield tail sealing according to claim 1, wherein the at least one outer sealing lip has a substantially triangular cross sectional shape.

3. Shield tail sealing according to claim 1, wherein the at least one outer sealing lip has at least one duct.

4. Shield tail sealing according to claim 3, wherein the at least one outer sealing lip has one single duct having a substantially triangular cross sectional shape; and said at least one outer sealing lip having two intersecting legs converging in an acute angle.

5. Shield tail sealing according to claim 4, wherein said legs each have a minimum wall thickness of 15 mm.

6. Shield tail sealing according to claim 4, wherein the wall thickness "a" of the leg adjacent to the shield tail is greater than the wall thickness "b" of the leg remote from the shield tail.

7. Shield tail sealing according to claim 3, wherein said at least one outer sealing lip has a two-row arrangement of ducts comprising a first row of ducts and a second row of ducts.

8. Shield tail sealing according to claim 7, wherein the first row of ducts facing the nose of the outer sealing lip is one single duct having an oval cross sectional shape; and wherein the second row of ducts facing the basic body comprises three ducts, each having a substantially circular cross sectional shape.

9. Shield tail sealing according to claim 3, wherein the at least one outer sealing lip has a three-row arrangement of ducts.

10. Shield tail sealing according to claim 9, wherein each duct has a substantially circular cross sectional shape and all ducts together form a triangularly shaped lattice structure.

11. Shield tail sealing according to claim 1, wherein the at least one outer sealing lip has a substantially finger-shaped cross sectional shape.

12. Shield tail sealing according to claim 1, wherein said sealing has two outer sealing lips having a substantially finger-shaped cross sectional form and substantially the same lip length "d".

13. Shield tail sealing according to claim 12, wherein the spacing "a" of the two outer sealing lips amounts to at least half the lip length "d".

14. Shield tail sealing according to claim 12, wherein one outer sealing lip is a front sealing lip in the zone of transition to the basic body having a notch disposed on the side remote from the shield tail.

15. Shield tail sealing according to claim 1, wherein on the side facing the outer side of the tunnel lining there is a shield jacket; and said sealing is fitted with an angled spring metal sheet fastened on the shield jacket and resting against the inner side within the upper zone of the basic body.

16. Shield tail sealing according to claim 1, further comprising a drag metal sheet anchored on the shield tail for protecting the nose of the outer sealing lip against abrasion.

* * * * *